United States Patent [19]

Steinfeld et al.

[11] 4,113,178

[45] Sep. 12, 1978

[54] RESILIENT RAIL CONNECTION

[75] Inventors: Horst E. Steinfeld, Villigst; Dieter Mathes, Hagen, both of Fed. Rep. of Germany

[73] Assignee: Hoesch Werke Aktiengesellschaft, Dortmund, Fed. Rep. of Germany

[21] Appl. No.: 762,347

[22] Filed: Jan. 25, 1977

[30] Foreign Application Priority Data

Jan. 27, 1976 [DE] Fed. Rep. of Germany ..... 2602869

[51] Int. Cl.[2] ..... E01B 9/30

[52] U.S. Cl. ..... 238/349; 238/310; 238/338

[58] Field of Search ..... 238/310, 315, 338, 349

[56] References Cited

U.S. PATENT DOCUMENTS

| | | | |
|---|---|---|---|
| 1,815,815 | 7/1931 | Vossloh | 238/349 |
| 3,309,023 | 3/1967 | Burwell | 238/349 |
| 3,640,460 | 2/1972 | Baseler | 238/349 |

*Primary Examiner*—Randolph A. Reese

*Attorney, Agent, or Firm*—Walter Becker

[57] ABSTRACT

A resilient rail connection on railway ties or the like with guiding plates located laterally of and adjacent to the rail. Each of the guiding plates along a section perpendicular to the longitudinal extension of the rail has a first end portion of an upwardly opening angular shape and an oppositely located second end portion for cooperation with a spring element. In fully assembled condition of the rail connection, the angular first end portion of each guiding plate rests in a correspondingly shaped recess arranged in the rail supporting under-structure such as a railway tie while being located remote from the rail, whereas the second end portion of each guiding plate is adjacent the foot portion of the rail and is under preload engaged by the spring element which resiliently rests on the same under-structure as the first end portion and urges the second end portion of the guiding plate upwardly. The guiding plates are respectively provided with oblong passages through which respectively extend adjustable connecting bolts firmly holding the guiding plates connected to the understructure.

6 Claims, 3 Drawing Figures

RESILIENT RAIL CONNECTION

The present invention relates to a resilient rail connection with railroad ties or the like with guiding plates arranged laterally adjacent said rail and partially embedded in the top side of the railroad ties. In cross section perpendicular to the rail, each guiding plate has a profile which at one end angularly opens in upward direction. The guiding plate on the side which faces away from the rail engages the tie with at least one inclined surface of said angle. The resilient rail connection is held by means of connecting screws and by means of spring elements which rest on the rail foot and correspond to the guiding plates.

A resilient rail connection of the above mentioned type has been described in German Pat. No. 12 57 817. The clamping piece according to this design does not need a base ribbed plate and is directly screwed into a concrete railroad tie by means of connecting screws. For laterally guiding the rail, there is provided an angular guiding plate which is positively connected to the concrete railroad tie.

The drawbacks inherent to this known resilient rail connection and also of other known solutions to the problem involved concern the consequences encountered by the movement of the rail in longitudinal direction, the so-called through thrust. When the rail moves in its longitudinal direction, the connecting screws in view of their power locked connection with the spring elements are subjected to bending stresses, and there exists the danger that they are sheared off if the forces become unduly high. The alternating stresses to which the connecting screws are subjected and which occur several times when moving over the rails will automatically reduce the lifespan of the connecting srews. Also, as the case may be, the effective shearing force will automatically reduce the lifespan of said connecting screws.

Furthermore, when employing resilient elements which are W-shaped as shown for instance in German Pat. No. 12 57 817, during a movement of the rail in longitudinal direction, there will be produced a high bending moment at the reversing points of the W-shaped spring element. This bending moment is composed of the product of through-thrust force and leg length of the spring element. In addition thereto, with the heretofore known embodiments of the resilient rail connections, the preload of the spring element is obtained through the intervention of the connecting screws. When improperly tightening the connecting screws, either too weak or too strong a preload of the spring will result. Either one of these faulty spring preloads will result in a negative effect on the spring behavior of the entire upper structure.

It is, therefore, an object of the present invention to provide a resilient connection of rails on railway ties of any type or on a tieless structure which is simple in design, comprises a movement of elements, permits a definite preload in conformity with the installation, a positive or force locked connection between rail and railroad ties and rail support, which will as far as possible avoid the occurrence of bending and thrust forces on the connecting screws and will keep the bending moment to be absorbed by the spring elements as low as possible.

These and other objects and advantages of the invention will appear more clearly from the following specification in connection with the accompanying drawings, in which.

The resilient rail connection according to the present invention is characterized primarily in that each guiding plate holds the spring element in a groove of a supporting bead. The groove extends parallel to the rail foot; the spring element ends in downholding fingers and rests on the rail foot; an oblong hole is provided which extends in a direction transverse to the rails. According to a further development of the invention, in built-in condition of the rail connection, the width of the groove of the guiding plate extends at least partially within the region of the oppositely located side surface of the rail foot.

Expediently, according to a further feature of the invention, the spring element, which establishes the connection between the guiding plate and the rail foot and which is guided in the groove of the guiding plate, has a holding web. The holding web in plan view is straight and in side view is slightly arched in vertical direction. The holding web outside the region of the guiding plate on both sides is provided with adjacent loops. The loops in side view in an opposing sense are curved approximately circularly in upward direction; a slight projection in the same direction of the loop ends ending in downholding fingers extends vertically from the plane in longitudinal direction of the holding web.

Figure 2:
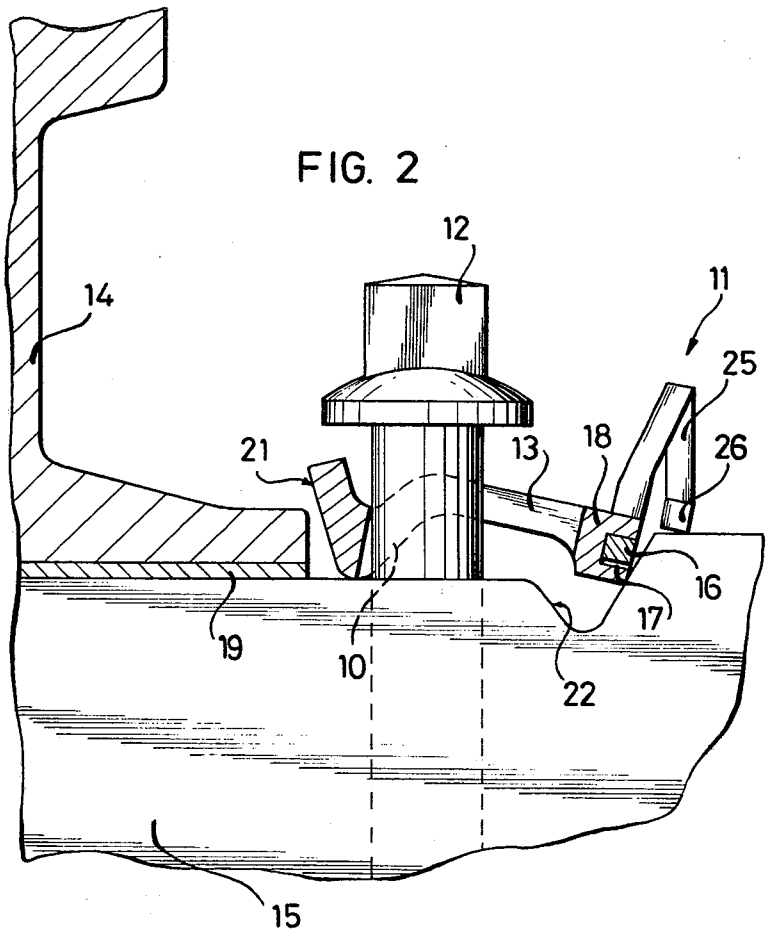
FIG. 2 shows the rail connecting elements in connection with another half of the rail in pre-assembled position.
Figure 1:
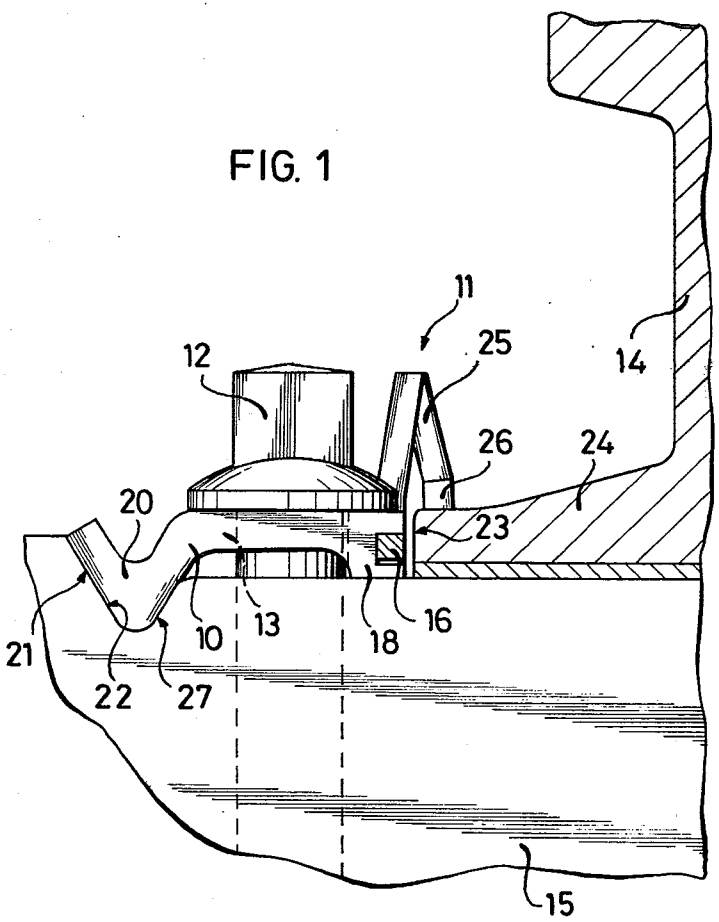
FIG. 1 shows partly in section one rail connection in the longitudinal direction of the rail.
Figure 3:
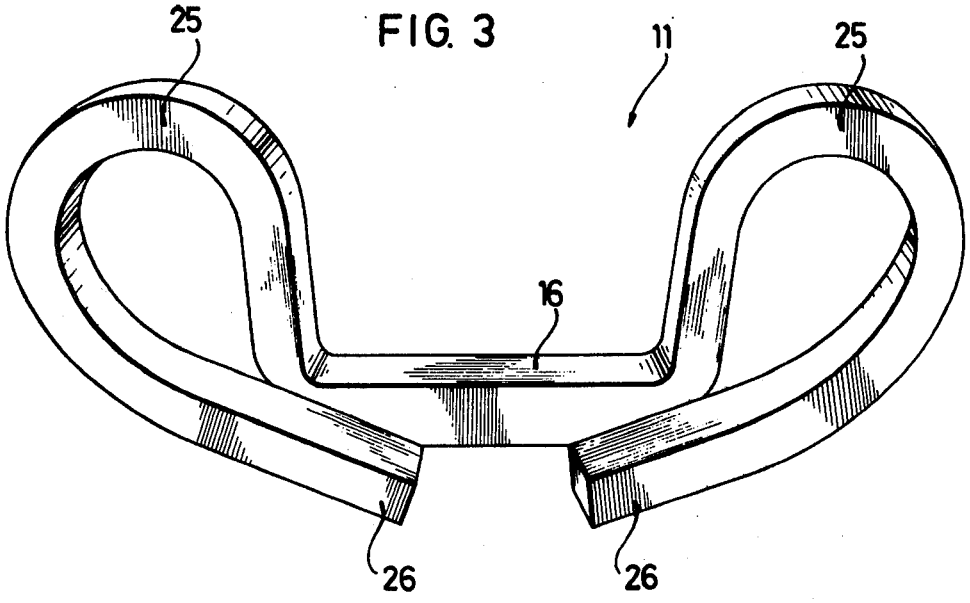
FIG. 3 illustrates a view of a spring element.

Referring now to the drawings in detail, a resilient rail connection comprising a guiding plate 10, a spring element 11 and one or more connecting screws 12, is pre-assembled in the manner shown in FIG. 2 in such a way that the guiding plate 10 is turned by 180° with regard to its final installed position. An oblong hole 13 provided in the guiding plate 10 in a direction transverse to the rail serves for guiding a connecting screw 12 and is so designed that when turning the guiding plate 10 by 180°, the free space necessary for the lowering of a rail 14 onto a substructure or base, for instance a railroad tie 15, is determined in conformity with the width of the rail foot. A spring element 11 with its holding web 16 is arched slightly in vertical direction and is inserted into a groove 17 of a supporting bead 18 of the guiding plate 10 with a certain preload so that the spring element 11 will be secured against a slipping out of the groove 17.

After the rail 14 has been lowered onto the railroad tie 15 and after an elastic intermediate layer 19 has been placed over the width of the rail foot, the preassembled rail connection is turned by 180° so that the supporting bead 18 will rest on the top side of the railway tie. An upwardly opened angular end 20 of the guiding plate 10 with its inclined surfaces 21 of the angle will engage a recess 22 of the tie 15. In this way, a positive connection is established with regard to the lateral forces of the rail to be conveyed to the tie 15, in particular since the lateral forces of the rail 14 are conveyed through the lateral surface 23 of the rail foot 24 to the supporting bead 18 of the guiding plate 10 and further onto the recess 22 in the tie 15.

The connecting screw 12 is thus relieved from lateral forces and merely serves for connecting the guiding plate 10. The resilient holding down of the rail 14 is effected by the spring element 11 which with its holding web 16 is held in the groove 17 of the supporting bead 18. This groove 17, in built-in condition, at least partially covers the lateral surface 23 of the rail foot 24 so that a displacement of the spring element 11 from the groove 17 in the direction of the rail 14 will be impossible. The spring element 11 subsequently merges at the holding web 16 on both sides with a loop 25 which is upwardly curved approximately circularly. This loop 25 ends in a holding-down finger 26 resting on the rail foot 24. This arrangement of the spring element 11 causes the tilting forces as well as the through thrust forces of the rail 14 to be absorbed by the spring element 11 and, in view of the established power connection, to be transferred into the tie 15.

As will be evident from the above, the advantage of the simple resilient rail connection according to the invention consists above all in that it can be used and exchanged for any types of ties and substructures. A further advantage of the invention consists in that the defined preload of the spring element is not dependent upon the tightening moment of the connecting screws. Furthermore, due to the fixed support of the guiding plate, no lateral forces are introduced into the connecting screws so that the lifespan of said screws will be considerably increased. In view of the arrangement of the spring element directly at and parallel to the rail foot, it will be assured that the introduction of the forces along the rail is effected through a power connection directly at the rail foot. Accordingly a reduction in the bending moments in the structural elements will be obtained as well as a relief in the connection screws from bending and shearing forces.

It is, of course, to be understood that the present invention is, by no means, limited to the specific showing in the drawings, but also comprises any modifications within the scope of the appended claims.

What we claim is:

1. In combination with a rail having a rail foot: a rail understructure supporting said rail and having recess means respectively arranged on opposite sides of said rail foot in spaced substantially parallel relationship adjacent thereto, each of said recess means being provided with at least one surface inclined to the longitudinal central plane of said rail, a plurality of guiding plates respectively associated with said recess means, each of said guiding plates having an upwardly opening angular first end portion and an oppositely located second end portion in close proximity to the lateral surface of said rail foot to limit lateral movement of said rail, each of said angular first end portions respectively resting in said recess means and engaging an inclined surface, a plurality of spring elements respectively constantly under pre-load engaging under said second end portions of said guiding plates and confined between said second end portions and the lateral surfaces of said rail foot and resiliently urging said second end portions in upward direction, said spring elements having resilient ends extending over said rail foot to press said rail downwardly on said understructure, said guiding plates respectively being provided with oblong passages, and adjustable connecting bolts respectively extending through said passages and against the thrust of said spring means holding said guiding plates in firm connection with said understructure.

2. The combination according to claim 1, in which each of said second end portions of said guiding plates is provided with a groove receiving directly a portion of said spring elements, the width of said grooves of said guiding plates extending at least within the region of the respective height of the adjacent rail foot.

3. The combination according to claim 1, in which each of said spring elements has a holding web which in plan view has a straight extension and in side view is slightly arched, and in which each of said spring elements outside the region of the pertaining guiding plate at both ends of said web is provided with an upwardly directed loop having a free downwardly extending end portion ending up in a plane slightly outwardly of the plane defined by said upwardly directed loops.

4. In combination with a rail having a rail foot, a rail understructure supporting said rail and formed with a recess having a wall spaced from and facing said rail foot and extending parallel to said rail, a guide plate between said rail foot and said wall, one end of said plate engaging said wall and the opposite end of said plate being in close proximity to the lateral surface of said rail foot to prevent lateral movement of said rail, said plate having an opening between its ends, and a fastening member extending through said opening to fasten said plate to said understructure, and a spring element having a central bar underlying the opposite end of said plate adjacent said rail foot, said central bar being confined between said opposite end of said plate and the lateral surface of said rail foot and resilient ends extending toward said rail from said central bar and overlying said rail foot, said ends pressing downwardly on said rail foot.

5. In combination with a rail having a rail foot, a rail understructure supporting said rail and formed with a recess having a surface inclined downwardly and toward said rail and spaced from and facing said rail, a guide plate between said rail foot and said wall, one end of said guide plate having a complementary inclined surface engaging the inclined surface of said recess and the opposite end of said plate being in close proximity to the lateral surface of said rail foot to prevent lateral movement of said rail, said plate having an opening extending between its ends, and a fastening member extending through said opening to fasten said plate to said understructure, said opening being substantially greater in length between said ends of said plate than the diameter of said fastener member so said plate may be turned about said fastener member and its other end withdrawn from close proximity with said rail foot, a spring element having a central bar and resilient ends formed to engage said rail foot, said other end of said plate overlying said central bar between said fastener member and rail foot and pressing said resilient ends into engagement with said rail foot, the central bar of said spring element being confined between the other end portion of said plate and the lateral surface of said rail foot, said plate when not pressed by said fastener member being rotatable to remove said other end of said plate and said spring element from proximity to said rail foot.

6. A railroad rail fastener structure for securing a railroad rail to an understructure under resilient pressure, comprising: a guide plate having a horizontal central portion, a downwardly projecting end portion having its end surface inclined downwardly and toward the vertical center line of said plate to engage a complementary surface on said understructure, a shoulder on the opposite end of said guiding plate to provide a horizontal recess underlying said shoulder between said shoulder and the lateral surface of said rail, a resilient element for engaging a rail foot having a central horizontal bar fitting in said recess under said shoulder and curved spring ends on said bar and projecting from said plate to overlie a rail foot adjacent the shoulder of said plate, said shoulder when said plate is engaged by a fastener bearing on said bar and pressing said spring ends down against said rail foot, said central horizontal portion having an opening extending the length of said central portion, so that said plate and resilient element may be raised and rotated to withdraw the guide plate from the rail foot and said resilient element may be removed from said recess.

* * * * *